US007999656B2

(12) United States Patent
Fisher

(10) Patent No.: US 7,999,656 B2
(45) Date of Patent: Aug. 16, 2011

(54) ELECTRONIC LOCK BOX WITH KEY PRESENCE SENSING

(75) Inventor: Scott R. Fisher, West Chester, OH (US)

(73) Assignee: SentriLock, LLC, Cincinnati, OH (US)

( * ) Notice: Subject to any disclaimer, the term of this patent is extended or adjusted under 35 U.S.C. 154(b) by 1141 days.

(21) Appl. No.: 11/584,940

(22) Filed: Oct. 23, 2006

(65) Prior Publication Data

US 2007/0090921 A1 Apr. 26, 2007

Related U.S. Application Data

(60) Provisional application No. 60/730,295, filed on Oct. 26, 2005.

(51) Int. Cl.

| | |
|---|---|
| ***G08B 13/14*** | (2006.01) |
| ***G08B 1/08*** | (2006.01) |
| ***E05B 67/00*** | (2006.01) |
| ***E05B 39/00*** | (2006.01) |

(52) U.S. Cl. ..... 340/5.73; 340/572.1; 340/569; 340/539.31; 340/572.8; 340/568.1; 70/35; 70/416; 70/439

(58) Field of Classification Search ..... None
See application file for complete search history.

(56) References Cited

U.S. PATENT DOCUMENTS

| | | | | |
|---|---|---|---|---|
| 4,808,993 | A | 2/1989 | Clark | |
| 5,377,906 | A * | 1/1995 | Mason | 232/34 |
| 5,397,884 | A | 3/1995 | Saliga | |
| 5,602,536 | A * | 2/1997 | Henderson et al. | 340/5.23 |
| 5,654,696 | A | 8/1997 | Barrett et al. | |
| 5,705,991 | A | 1/1998 | Kniffin et al. | |
| 5,742,236 | A * | 4/1998 | Cremers et al. | 340/5.26 |
| 5,895,075 | A * | 4/1999 | Edwards | 283/81 |
| 6,262,664 | B1 * | 7/2001 | Maloney | 340/572.8 |
| 6,472,973 | B1 | 10/2002 | Harold et al. | |
| 6,624,742 | B1 | 9/2003 | Romano et al. | |
| 6,678,612 | B1 | 1/2004 | Khawam | |
| 6,731,211 | B1 * | 5/2004 | King | 340/568.1 |
| 6,989,732 | B2 | 1/2006 | Fisher | |
| 7,009,489 | B2 | 3/2006 | Fisher | |
| 7,086,258 | B2 | 8/2006 | Fisher et al. | |
| 7,177,819 | B2 | 2/2007 | Muncaster et al. | |
| 7,340,400 | B2 * | 3/2008 | McGinn et al. | 705/317 |
| 2002/0044055 | A1 * | 4/2002 | Maloney | 340/571 |

(Continued)

FOREIGN PATENT DOCUMENTS

| | | |
|---|---|---|
| EP | 1 410 346 B1 | 9/2006 |
| GB | 2 364 413 B | 11/2004 |

OTHER PUBLICATIONS

International Search Report, PCT/GB01/02908, 4 pages (Jul. 19, 2002).

(Continued)

*Primary Examiner* — Jennifer Mehmood
*Assistant Examiner* — Fekadeselassie Girma
(74) *Attorney, Agent, or Firm* — Frederick H. Gribbell

(57) ABSTRACT

An electronic lock box contains a secure compartment for storing keys to a structure. A sensing system allow the lock box to determine whether the contents of the lock box have been replaced as well as ensuring the correct key or object has been returned. The system reports the status of the object back to the central clearinghouse computer through an electronic key or secure memory device.

48 Claims, 6 Drawing Sheets

U.S. PATENT DOCUMENTS

| | | | | |
|---|---|---|---|---|
| 2002/0075154 | A1* | 6/2002 | Maloney | 340/573.1 |
| 2004/0025039 | A1 | 2/2004 | Kuenzi et al. | |
| 2004/0058453 | A1* | 3/2004 | Free et al. | 436/183 |
| 2004/0143498 | A1* | 7/2004 | Umeda | 705/14 |
| 2004/0160304 | A1* | 8/2004 | Mosgrove et al. | 340/5.21 |
| 2004/0252017 | A1 | 12/2004 | Holding et al. | |
| 2005/0205663 | A1* | 9/2005 | Algiene | 235/380 |
| 2006/0059964 | A1* | 3/2006 | Bass et al. | 70/408 |

OTHER PUBLICATIONS

Preliminary Examination Report, PCT/GB01/02908, 19 pages (Oct. 18, 2002).

International Search Report, PCT/US08/006718, 13 pages (Aug. 8, 2008).

* cited by examiner

ELECTRONIC LOCK BOX WITH KEY PRESENCE SENSING

CROSS-REFERENCE TO RELATED APPLICATIONS

The present application claims priority to provisional patent application Ser. No. 60/730,295, titled "ELECTRONIC LOCK BOX WITH KEY RETURN SENSING," filed on Oct. 26, 2005.

TECHNICAL FIELD

The present invention relates generally to electronic lock equipment and is particularly directed to an electronic lock box of the type that contains a secure compartment for storing keys that allow entry to a building or other structure. The invention is specifically disclosed in as an electronic lock box that includes sensors which can determine whether a mechanical key is present within the secure compartment, which also allows the electronic lock box to determine if the user of the contents (e.g., a mechanical key) of the lock box returns the key to the secure compartment of the lock box, prior to closing the secure compartment's door.

BACKGROUND OF THE INVENTION

In the real estate industry, a need exists for controlled access to homes for sale that is both flexible to serve the real estate professional and secure for the homeowner's peace of mind. The traditional method has been the use of a key safe or a lock box that attaches to the homeowner's doorknob and contains the dwelling key. Many conventional designs ranging from mechanical to electronic have been used over the years to provide this functionality. Homeowners prefer electronic systems because, unlike their mechanical counterparts, the electronic systems offer greater security and control over who has access to the dwelling key, and further offers the ability to track accesses to the secure compartment that holds the key.

One challenge in previous designs has been the lack of control of the lock box contents. Homeowners have expressed a concern that a key will be lost, stolen, or copied by an unscrupulous person. Previous electronic lock box systems have addressed many aspects of logging the identity of who has accessed the contents (e.g., a key) of the lock box, but none has addressed the need for determining whether the contents were returned and the key compartment secured.

Advances in electronics in the field of radio frequency identification (RFID) and infrared (IR) communications have now provided an available means to develop a cost-effective solution to the deficiencies of existing lock box technology, thereby improving security and peace of mind.

SUMMARY OF THE INVENTION

Accordingly, it is an advantage of the present invention to provide an electronic lock box system used in real estate sales systems that provides a method of determining whether a key (or other object) was properly replaced into the secure compartment of the lock box. A further advantage is the ability to identify whether a dwelling key has been potentially been copied. Yet another advantage is to record for future review who accessed the lock box contents and whether they replaced the key (or other object), and further whether the person accessing the lock box properly closed the key compartment door.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an electronic lock box system is provided, which comprises: an electronic lock box apparatus having a control circuit, a memory circuit, an identifier sensing device, a secure compartment with an access element, and a shackle for attachment to a fixed object, wherein the control circuit is configured to exchange data signals with the identifier sensing device; and a security apparatus having an identification member, and an attachment member; wherein: (a) the identifier sensing device detects a presence of the identification member of the security apparatus, if the security apparatus is positioned within the secure compartment; and (b) the identifier sensing device detects an absence of the identification member of the security apparatus, if the security apparatus is not positioned within the secure compartment.

In accordance with another aspect of the present invention, a security apparatus used with an electronic lock box system is provided, which comprises: (a) an identification member, which includes an identification control circuit, a memory circuit having alterable memory elements, a wireless transceiver, and at least one input/output circuit; and (b) an attachment member for use with an external key; (c) wherein: the identification control circuit is configured to perform at least one of the following functions: (i) to modify a data value of the alterable memory elements, in response to the attachment member becoming detached from the key; and (ii) to disable itself in response to the attachment member becoming detached from the key.

In accordance with yet another aspect of the present invention, a security apparatus used with an electronic lock box system is provided, which comprises: (a) an identification member, which comprises one of: (i) a bar code label; and (ii) an radio frequency identification (RFID) tag; (b) an attachment member for use with an external key; wherein the identification member becomes unreadable in response to the attachment member becoming detached from the external key.

In accordance with still another aspect of the present invention, an electronic lock box is provided, which comprises: an electronic lock box apparatus having a control circuit, a memory circuit, a secure compartment with an access element, and a shackle for attachment to a fixed object; and an access element sensing circuit that detects whether the secure compartment is in one of: (a) an open state; and (b) a closed state; wherein the control circuit is configured to exchange data signals with the access element sensing circuit.

In accordance with a further aspect of the present invention, a method for operating an electronic lock box system is provided, in which the method comprises the following steps: providing an electronic lock box apparatus having a control circuit, a memory circuit, an identifier sensing device, a secure compartment with an access element, and a shackle for attachment to a fixed object; providing a key with a security apparatus attached thereto, the security apparatus having an identification member, and an attachment member, the attachment member being used for attaching the security apparatus to the key; and using the identifier sensing device, detecting a presence of the identification member of the security apparatus, if the security apparatus is positioned within the secure compartment.

In accordance with a yet further aspect of the present invention, a method for operating an electronic lock box system is provided, in which the method comprises the following steps: providing an electronic lock box apparatus having a control circuit, a memory circuit, an identifier sensing device, a secure compartment with an access element, an access element status detection device, and a shackle for attachment to a fixed object; installing the lock box apparatus at the fixed object by use of the shackle; installing a key within the secure compartment, the key having a security apparatus attached thereto; detecting an access attempt of the secure compartment by an authorized user; and before opening the secure compartment access element, detecting, by use of the identifier sensing device, a presence of the security apparatus, if the security apparatus is positioned within the secure compartment.

In accordance with a still further aspect of the present invention, a method for operating an electronic lock box system is provided, in which the method comprises the following steps: providing an electronic lock box apparatus having a control circuit, a memory circuit, an identifier sensing device, a secure compartment with an access element, and a shackle for attachment to a fixed object; installing the lock box apparatus at the fixed object by use of the shackle; installing a key within the secure compartment, the key having a security apparatus attached thereto; and polling, under the control of the electronic lock box apparatus control circuit, the identifier sensing device to detect whether the security apparatus is positioned within the secure compartment.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Figure 1:
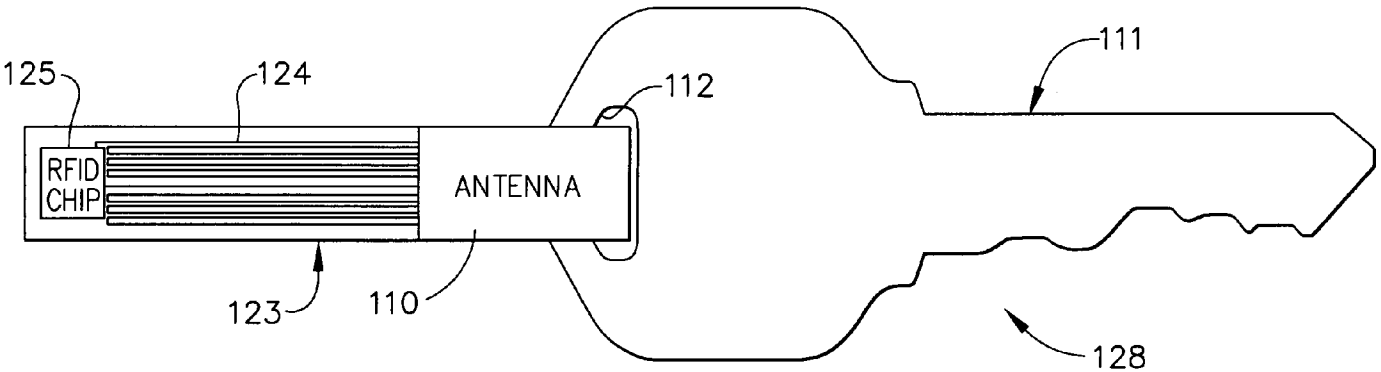
FIG. 1 is a side view of a mechanical key for use with an electronic lock box, as constructed according to the principles of the present invention, in which the key has a security tag that includes a RFID chip.

Reference will now be made in detail to the present preferred embodiment of the invention, an example of which is illustrated in the accompanying drawings, wherein like numerals indicate the same elements throughout the views.

The present invention offers improvements to conventional electronic lock box systems, in which there are two main system components. The first main component is a specially designed "key security apparatus;" and the second main component provides additional sensors to the base (standard) lock box electronics, for communicating or retrieving data from the key security apparatus, as well as additional sensor elements to determine the key compartment's latching state.

Other aspects of the electronic lock box of the present invention are more fully described in earlier patents and patent applications by the same inventor, including Ser. No. 10/172,316, filed on Jun. 14, 2002, titled "ELECTRONIC LOCK SYSTEM AND METHOD FOR ITS USE," now U.S. Pat. No. 7,009,489 B2; Ser. No. 10/267,174, filed on Oct. 9, 2002, titled "ELECTRONIC LOCK SYSTEM AND METHOD FOR ITS USE WITH CARD ONLY MODE," now U.S. Pat. No. 6,989,732 B2; Ser. No. 10/805,020, filed on Mar. 19, 2004, titled "ELECTRONIC LOCK BOX WITH SINGLE LINEAR ACTUATOR OPERATING TWO DIFFERENT LATCHING MECHANISMS," now U.S. Pat. No. 7,086,258 B2; Ser. No. 10/805,018, filed on Mar. 19, 2004, titled "ELECTRONIC LOCK BOX WITH MULTIPLE MODES AND SECURITY STATES, now U.S. Pat. No. 7,420,456;" and Ser. No. 11/193,932, filed on Jul. 29, 2005, titled "ELECTRONIC LOCK SYSTEM AND METHOD FOR ITS USE WITH A SECURE MEMORY CARD, now U.S. Pat. No. 7,193,503."

The present invention is an improvement to these earlier designs, allowing a greater level of security by determining if the secured object (e.g., a mechanical key) has been properly returned to the lock box. This is in response to [a] complaints with older lock box technology, in which dwelling keys sometimes are not replaced in the key compartment, either intentionally or accidentally, thus creating concern for the homeowner and inconvenience for real estate agents or contractors later attempting to access the key. It is another feature of the present invention that it can be determined whether the dwelling key has potentially been copied. A further feature of this invention adds a sensor to the key compartment door which sends a signal that is used to record in non-volatile memory (at the lock box) whether the last person who accessed the key compartment actually closed and secured the door.

Key Security Apparatus

The key security apparatus can be as simple as a bar code decal on a key fob, or the key fob may contain electronic circuitry to provide a unique identification number, in the form of a signal for example, when communicating with the lock box controller. This communication between the lock box microcontroller and the key fob can be performed via, for example, an analog or digital RF (radio frequency) signal, an infrared link, a bar code detection scheme, a sense loop, or through an RFID-type communication system. To prevent tampering with the system, one of at least two methods can be employed to ensure that a fake key is not attached to the key security apparatus, and also to potentially identify if the key has possibly been copied.

A first method allows for a disposable key identification device in the form of passive electronics and an antenna that provide a unique response to an RF signal, in the form of inexpensive RFID (radio frequency identification) tags 123 (see FIG. 1). The disposable key security apparatus 123 is designed in such a way so that it will be rendered inkperable (in an unreadable state) if it is removed from the key (or other object) 128 that it is attached to. This can be accomplished, for example, by utilizing an antenna wire 122 that loops through the key ring hole 112 (or other opening in the object; see FIG. 2), or perhaps using a fiber optic cable as the "antenna loop." The antenna loop could merely be a wire 122 acting as an electrical conductor to complete an electrical circuit, or the antenna loop could indeed comprise an antenna 110, such as an antenna used in an RFID tag. To remove the key (or other object) from the key security apparatus (e.g., on the key fob), the antenna loop must be cut or otherwise detached from the key, thus breaking the electrical circuit or otherwise rendering the communication link inoperable.

In the embodiment of FIG. 1, the key assembly generally designated by the reference numeral 128 includes a tag subassembly 123. This tag subassembly has an RFID chip 125, with an antenna portion 110 and electrically conductive foil paths 124 that connect between the RFID chip 125 and the antenna portion 110. If the RFID tag subassembly 123 is physically removed from the mechanical key 111 of this total assembly 128, it would have to be by clipping or otherwise cutting the antenna portion 110, or breaking one portion of the antenna 110 so that it can come free from the rest of the ID tag 123 and therefore can be removed from the opening 112 in the key 111. By creating an open circuit by cutting or otherwise pulling apart the antenna portion 110, the RFID tag subassembly 123 will become non-operable, and the sensing circuitry will know that something untoward has happened to the key assembly 128. In the embodiment of FIG. 1, the only way to remove the key security apparatus subassembly 123 from the mechanical key 111 is to cut or otherwise separate the antenna 110, or to literally cut a slot in the mechanical key 111 to allow the antenna to become separated physically from the key 111. Of course, someone will eventually notice the destructive slot in the key 111 and this will immediately bring suspicion onto the previous users of the electronic lock box that accessed this particular key assembly 128.

Figure 2:
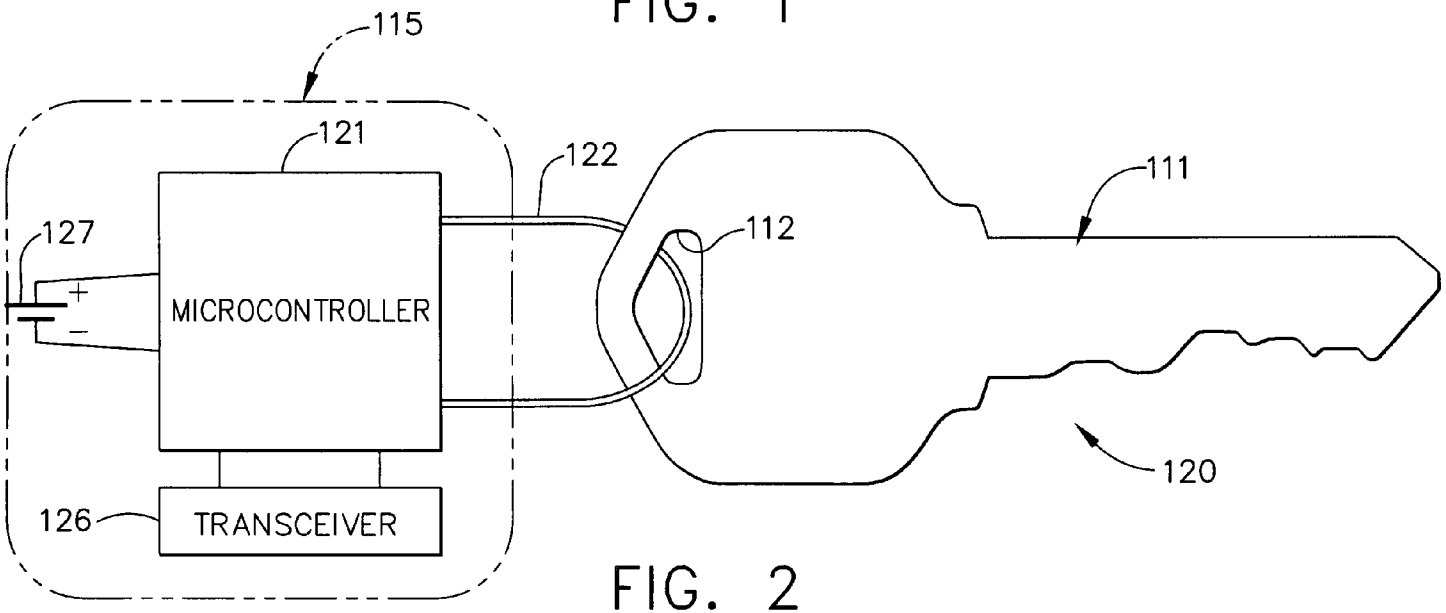
FIG. 2 is a side view of a mechanical key for use with an electronic lock box, as constructed according to the principles of the present invention, in which the key has a security tag that includes an electronic security circuit with a sense loop.

With respect to the embodiment of FIG. 2, the mechanical key assembly is generally designated by the reference numeral 120, and includes a mechanical key 111 that has an opening 112. In this key assembly 120, there is a key security apparatus subassembly 115 that contains a microcontroller 121 with an "antenna loop" 122. A small battery 127 powers the microcontroller 121, and a transceiver circuit 126 allows for external communications to and from microcontroller 121, using the antenna loop 122. In the embodiment of FIG. 2, the only way to remove the key security apparatus subassembly 115 from the mechanical key 111 is to cut or otherwise separate the antenna loop 122, or to literally cut a slot in the mechanical key 111 to allow the antenna loop 122 to become separated physically from the key 111. Of course, someone will eventually notice the destructive slot in the key 111 and this will immediately bring suspicion onto the previous users of the electronic lock box that accessed this particular key assembly 120.

If the antenna 122 is cut or otherwise mangled and separated at the microcontroller, then the transceiver 126 will no longer be able to communicate with external devices, and the key assembly 120 will no longer function properly. The electronic lock box will notice this, when it tries to communicate with the key assembly 120, and will act accordingly.

In FIG. 2, the subassembly 115 can be in the form of a "key fob," which contains other components therewithin, such as the microcontroller 121 and transceiver 126.

An alternative methodology could use a bar code label that is fabricated in such a way as to become unreadable upon peeling or cutting it off the key or object. For example, the bar code label could be made of a material that releases a dye or other chemical that alters the color of the label if the label is tampered with (e.g., if it is cut or torn from the key). The chemical could cause the white areas of a bar code label to turn black, for example, thereby making it impossible for the bar code to later be inspected by a bar code reader.

Figure 3:
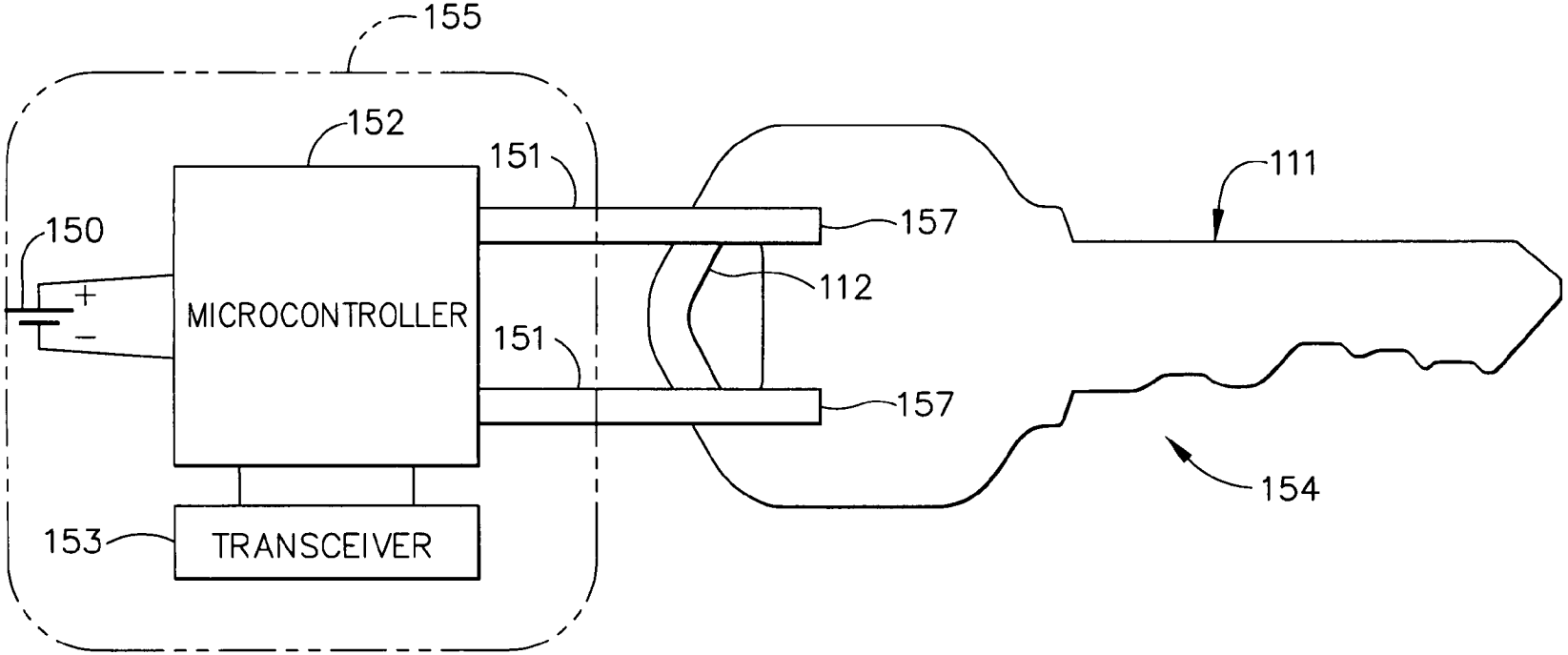
FIG. 3 is a side view of a mechanical key for use with an electronic lock box, as constructed according to the principles of the present invention, wherein the key has a security tag that includes an electrical circuit that makes electrical contact with the key, in which the electrical conductivity of the key completes an electrical "sense" circuit.

An example of this alternative methodology is illustrated in FIG. 3, by which there is a mechanical key assembly generally designated by the reference numeral 154. The two major components of the assembly 154 are a mechanical key 111 and a key security apparatus subassembly 155. In FIG. 3, the subassembly 155 can be in the form of a "key fob," which contains other components therewithin. In the key assembly 154, the key fob 155 includes a microcontroller 152 with a small battery 150, and a transceiver circuit 153 that allows the microcontroller to communicate to an external device; these components form an "identification member" of the security apparatus 155.

Microcontroller 152 has two electrically conductive leads 151 that make electrical contact with the mechanical key 111 at "clamping" regions 157. The leads 151 extend to the front side of the mechanical key 111, as seen on FIG. 3, and moreover, a portion of the leads 151 have a second component hidden in this view that makes contact on the opposite side of the mechanical key 111 and thereby tends to grasp the key by a clamping or spring action (again at the region 157, for example).

These leads form an "attachment member" of the security apparatus 155. Assuming the mechanical key 111 is made of an electrically conductive material, then if the mechanical key is removed from the electrical leads 151, the microcontroller 152 will sense a change of state in the electrical conductivity of the circuit path through the electrical leads 151. This change of state may only be temporary, but the microcontroller will be programmed to note the change of state and store it in a memory location that preferably is non-volatile. Once this has occurred, the microcontroller can send a message using the transceiver 153 to an electronic lock box, or to an electronic key or other type of external device that can be in communication with the transceiver 153, and by that methodology, it will become known that the mechanical key 111 was removed from the electrical leads 151. A time and date stamp can also be stored when the lock box notices this new status, to further narrow the possibilities of which person may have done the key removal. This information can be transferred to a central clearinghouse computer, such as the clearinghouse computer system 60 on FIG. 7, and the REALTOR® Board will then have knowledge of this key removal incident.

It will be understood that various types of mechanical and electrical connections can be made between a pair of electrical conductors such as those designated by the reference numeral 151 on FIG. 3, and a mechanical key 111. These interconnections can even be semi-permanent, such as a small tack weld at the areas 157 on the electrical leads 151, or the use of a screw; or perhaps the most useful interconnection would be some type of spring-loaded device that will provide a strong clamping action. A bend in the electrical leads 151 to form a leaf spring effect would probably be the simplest and cheapest methodology for this mechanical/electrical interconnection.

Another alternative methodology is to provide a permanent re-codeable key security apparatus that senses its removal from the key or other object. Upon removing the key security apparatus from the key, an internal code changes or is rendered unreadable until refreshed or re-enabled through a process only available to the owner of the lock box. One embodiment of this method is for the key security apparatus to use a metallic conductor, such as a screw, to complete an electrical circuit when the key is attached to the key security apparatus (e.g., to a key fob). In this embodiment, detaching the key security apparatus from the key would require removing the screw, which causes a circuit to be broken. When that occurs, the internal microcontroller in the key security apparatus will re-code its unique identification number, or it will otherwise disable the function of reading the identification code, until it later is re-enabled by action of the lock box owner.

Figure 5:
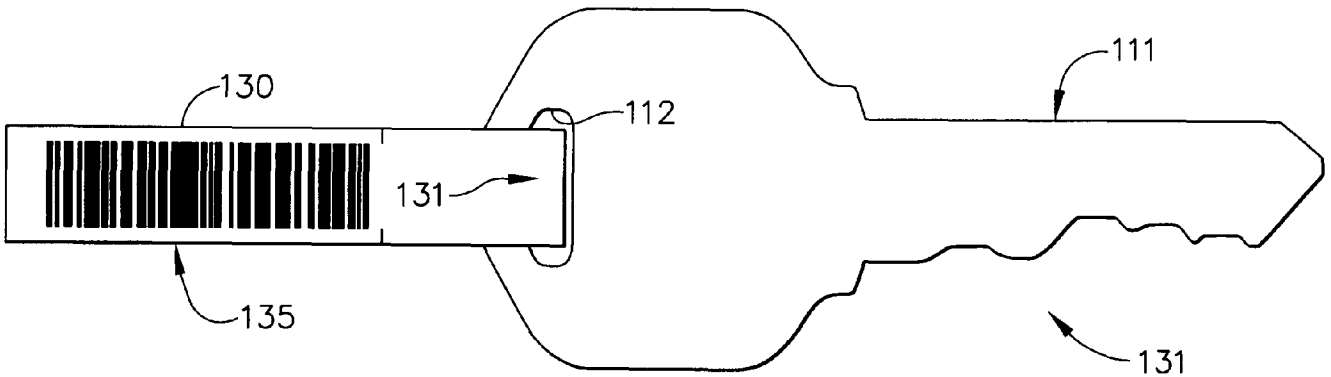
FIG. 5 is a side view of a mechanical key for use with an electronic lock box, as constructed according to the principles of the present invention, in which the key has a bar code security tag, which can be read by a bar code scanning device, and thereby forms something of an "optical sense loop" to increase security.
Figure 6:
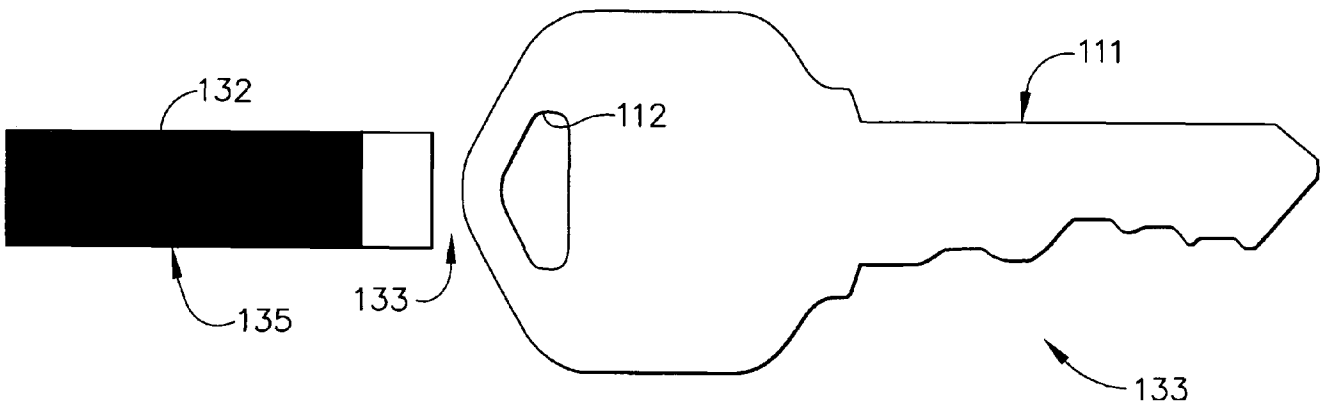
FIG. 6 is a side view of the mechanical key of FIG. 5, in which the bar code has been rendered unreadable by action of a dye or ink that is activated by the removal of the bar code security tag from the key.

An example of this alternative methodology is depicted in FIGS. 5 and 6. In FIG. 5, a key assembly 131 has two major components, a mechanical key 111 and a bar code tag 135. The bar code tag 135 has a bar code label portion at 130, and an extensible portion 131 that wraps through the opening 112 in the mechanical key 111. So long as the extensible portion 131 is not traumatically disturbed, the bar code label 130 will remain visible. However, if the extensible portion 131 is cut or torn, the result would be the embodiment generally designated by the reference numeral 133 as seen in FIG. 6. The bar code tag 135 still exists, however, an ink or dye has been released by the tearing action and obliterates the bar code label that was seen at 132. The extensible portion that formerly went through the opening 112 and the mechanical key 111 has now been cut or torn at the area 133 on FIG. 6. It will be understood that other methodologies for obliterating or deforming bar code labels or other visible indicia can be used without departing from the principles of the present invention.

The methods described above also allow the addition of a second security feature that inhibits the potential for covert mechanical copying of the key. The key security apparatus can be designed with sufficient "extra" material, such as plastic or metal, around the head of the key which prevents the entire key with its security apparatus from being inserted or clamped in a standard key duplicating machine. Such a structure would be difficult to remove without altering the key assembly to an extent that would raise suspicion if the altered key is later presented to a key duplicator.

With regard to the embodiment 120 depicted in FIG. 2, An alternative sense loop could use a fiber optic cable that passes through the opening 112 (e.g., a hole) in the key 111. An LED emitter on one end of the cable could transmit pulses of light which are received at the other end by a photodetector. This optoelectronic assembly could be polled periodically by the microcontroller 121, and an absence of a received pulse after a transmitted pulse could then be used to determine that the key had been detached.

Another possible embodiment would use a simple contact switch (e.g., an electromechanical limit switch) that changes state when the key is present within the secure compartment. The limit switch circuit could be periodically polled by a microcontroller, if desired, or if a digital input line is available, the limit switch circuit could be directly connected into such digital input and the microcontroller would be able to directly sense a change of state in the switch's contact.

The embodiments described in connection with FIGS. 1-3 represent different types of mechanical keys that could be used in an electronic lock box found in many real estate sales situations, as discussed above. Although the actual keys described so far have been "mechanical" keys, such as the key 111 in FIGS. 1-3, it will be understood that other types of dwelling keys could be used to open doors of a dwelling, and such other types of keys could be stored in the secure compartment of an electronic lock box. Various types of non-mechanical keys will likely become popular in the future, and such keys could involve low-power radio transmitters such as the type used for unlocking automobile doors, for example, or other electromagnetic energy in the form of a low-powered light signal.

Figure 4:
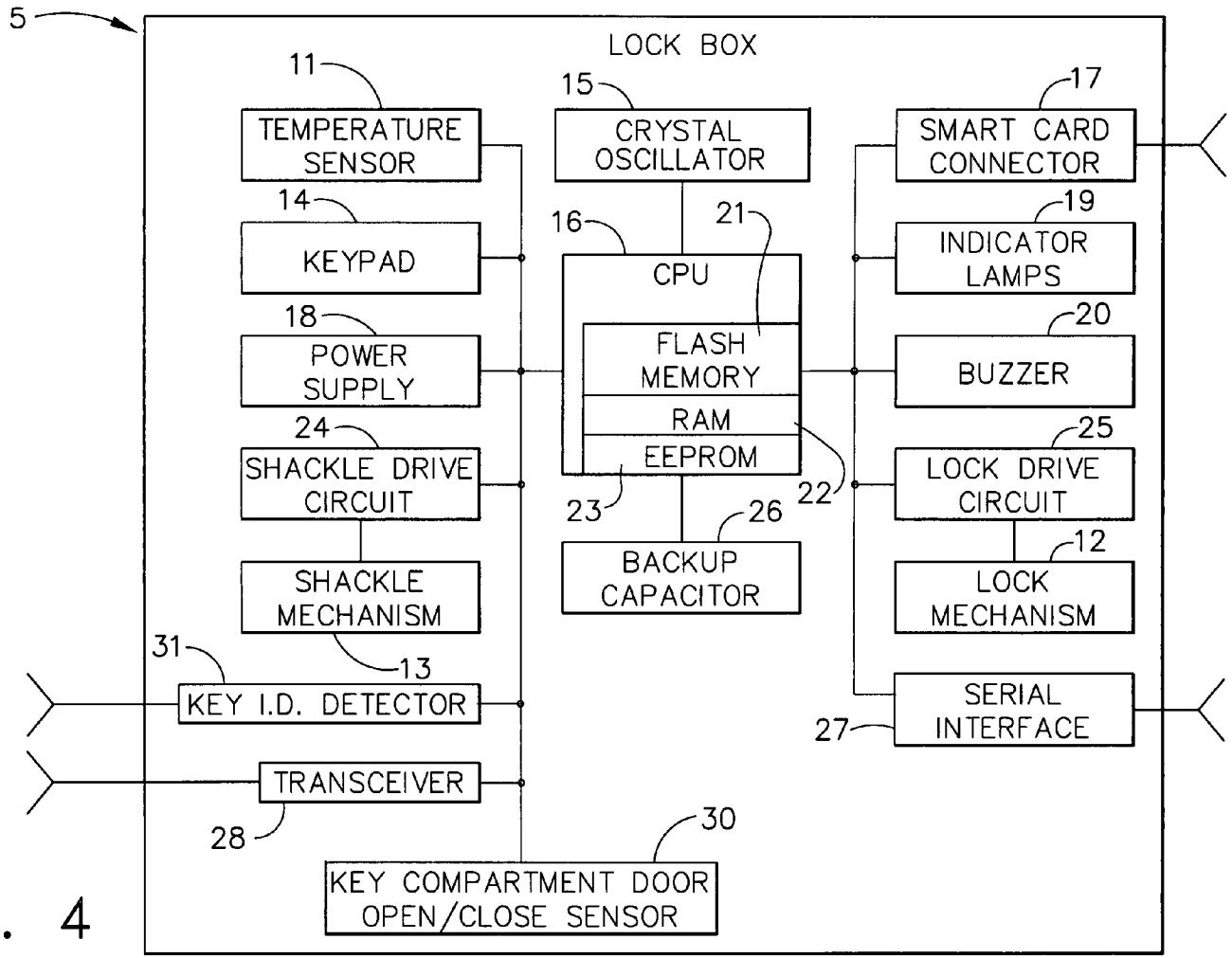
FIG. 4 is a block diagram showing some of the major hardware components of an electronic lock box system that communicates with an identification device, such as an RFID transceiver circuit, as constructed according to the principles of the present invention.
Figure 7:
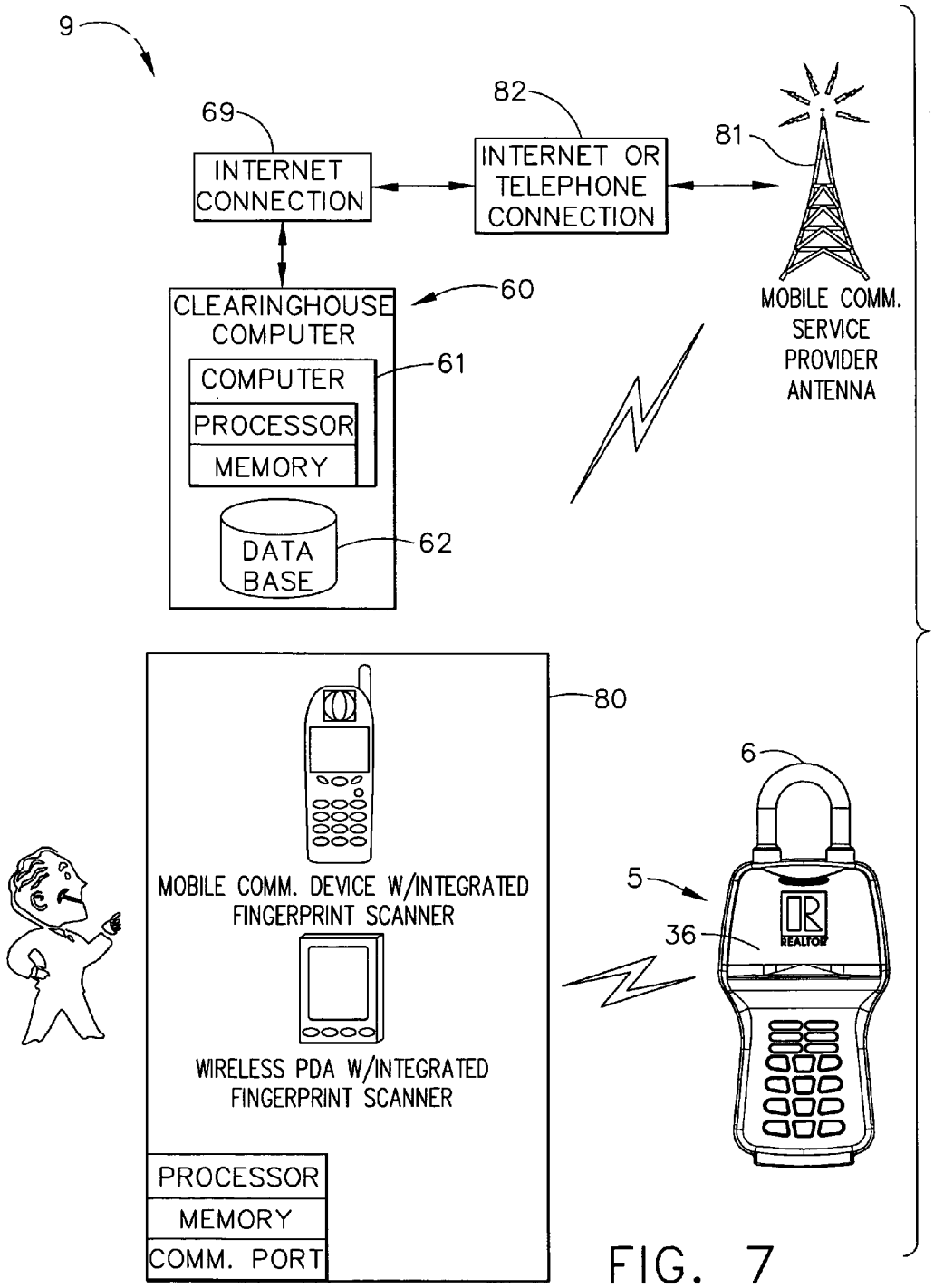
FIG. 7 is a diagrammatic view of the major components of a portable electronic lock box security system, as constructed according to the principles of the present invention, including a clearinghouse computer station, a wireless communications device, and a portable electronic lock box apparatus.
Figure 8:
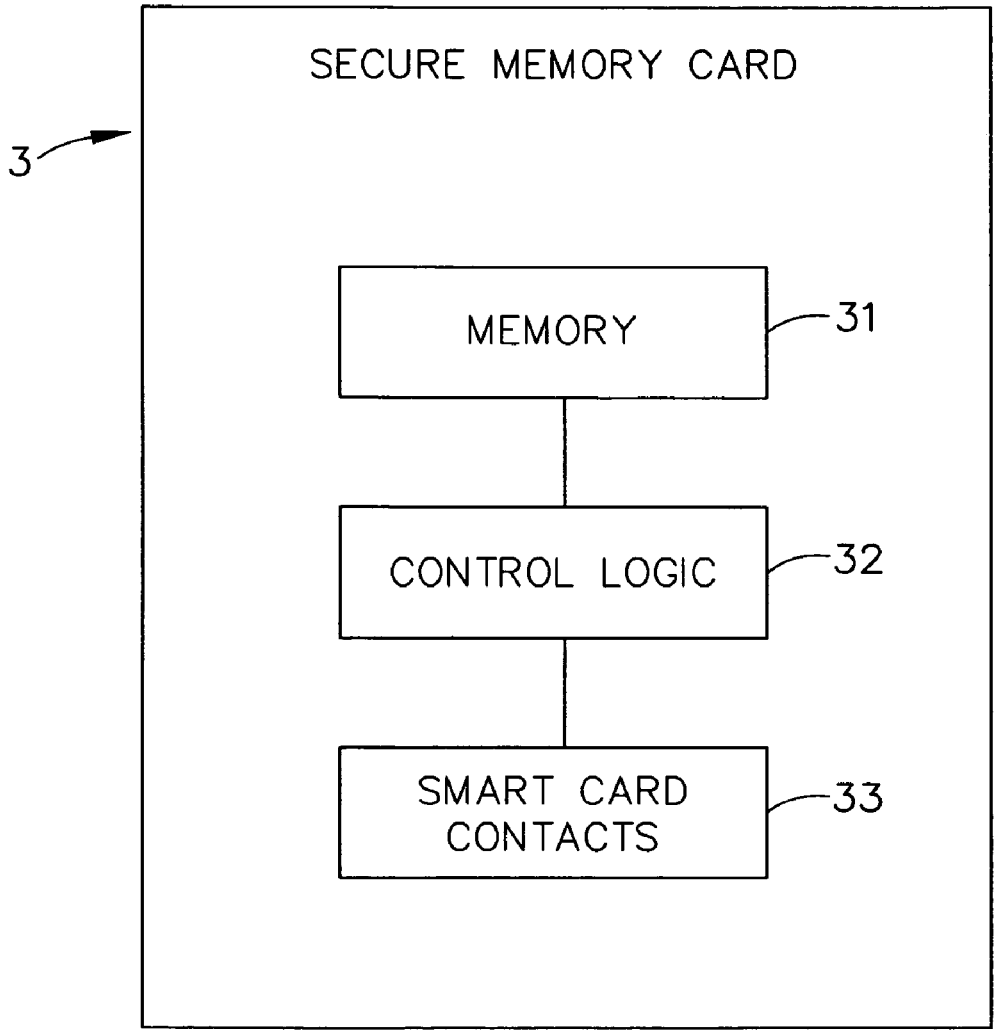
FIG. 8 is a schematic block diagram of a secure memory card used in the portable electronic lock box security system of FIG. 7.

The type of electronic lock box that can be used in the present invention has been described in the earlier patent applications and issued patents that were noted above. A block diagram of some of the major components of a suitable electronic lock box, generally designated by the reference numeral 5, is illustrated in FIG. 4. Most of the components listed in this block diagram are also found in the earlier versions of an electronic lock box sold by SentriLock, Inc. of Cincinnati, Ohio, and invented by the same inventor as the present invention. A brief description of these components follows:

Description of Electronic Lock Box:

The electronic circuitry of electronic lock box 5 is illustrated in block diagram form in FIG. 7. Electronic lock box 5 includes a microprocessor (CPU) 16, FLASH memory 21, random access memory (RAM) 22, EEPROM (electrically erasable programmable read only memory) 23, a battery (or other electrical power supply) 18, a memory backup capacitor 26, an ISO-7816 smart card connector 17, indicator LED lamps 19, a piezo buzzer 20, a crystal oscillator 15, a digital temperature sensor 11 (these last two devices can be combined into a single chip) a shackle drive circuit 24, a shackle release mechanism 13, a key compartment mechanism drive circuit 25, a key compartment lock/release mechanism 12, and a membrane style keypad 14 for user data entry. A serial interface 27 is also included so that the CPU 16 is able to communicate with other external devices, such as a separate portable computer in the form of a PDA (personal digital assistant) or other type of portable computing device that uses a serial data link. For example, serial interface 27 can comprise in infrared (IR) port that communicates with a standard IR port found on many PDA's; or it could use a different communications protocol, such as BlueTooth.

Microprocessor 16 controls the operation of the electronic lock box 5 according to programmed instructions (electronic lock box control software) stored in a memory device, such as in FLASH memory 21. RAM memory 22 is typically used to store various data elements such as counters, software variables and other informational data. EEPROM memory 23 is typically used to store more permanent electronic lock box data such as serial number, configuration information, and other important data. It will be understood that many different types of microprocessors or microcontrollers could be used in the electronic lock box system 5, and that many different types of memory devices could be used to store data in both volatile and non-volatile form, without departing from the principles of the present invention. In one mode of an exemplary embodiment, the electronic lock box CPU 16 is an 8-bit Atmel Mega8 microcontroller that incorporates RAM 22, FLASH memory 21 and EEPROM memory 23 internally (as on-board memory).

Battery 18 provides the operating electrical power for the electronic lock box. Capacitor 26 is used to provide temporary memory retention power during replacement of battery 18. It will be understood that an alternative electrical power supply could be used if desired, such as a solar panel with the memory backup capacitor.

Electronic lock box 5 includes a shackle 6 that is typically used to attach the box 5 to a door handle or other fixed object. Electronic lock box 5 also includes a key compartment 10 which typically holds a dwelling key (not shown), and which can be accessed via a key access door 36 (which is also referred to herein as a "controlled access member").

The key compartment lock and release mechanism 12 uses a gear motor mechanism (not shown) that is controlled by drive circuit 25 that in turn is controlled by CPU 16. Shackle release mechanism 13 also uses a gear motor, which is controlled by drive circuit 24 that in turn is controlled by CPU 16. It will be understood that the release or locking mechanisms used for the shackle 6 and key compartment 36 can be constructed of many different types of mechanical or electromechanical devices without departing from the principles of the present invention.

The crystal oscillator 15 provides a steady or near-constant frequency (e.g., at 32.768 kHz) clock signal to CPU 16's asynchronous timer logic circuit. The ISO-7816 smart card connector 17 connects to smart card contacts 33 to allow the exchange of data between the electronic lock box's CPU 26 and the memory devices 31 in the smart card 3 (discussed below in greater detail). The smart card 3 itself typically will include some control logic circuits 32, to prevent "easy" or unauthorized access to the memory elements 31 on-board the card 3.

In one embodiment, the digital temperature sensor 11 is read at regular intervals by the electronic lock box CPU 16 to determine the ambient temperature. Crystal oscillator 15 may exhibit a small change in oscillating characteristics as its ambient temperature changes. In one type of crystal oscillator device, the oscillation frequency drift follows a known parabolic curve around a 25 degrees C center. The temperature measurements are used by CPU 16 in calculating the drift of crystal 15 and thus compensating for the drift and allowing precise timing measurement regardless of electronic lock box operating environment temperature. As noted above, a single chip can be used to replace the combination of crystal oscillator 15 and temperature sensor 11, such as a part number DS32KHZ manufactured by Dallas Semiconductor, generally designated by the reference numeral 37 on FIG. 3.

LED indicator lamps 19 and a piezo buzzer 20 are included to provide both an audible and a visual feedback of operational status of the electronic lock box 5. Their specific uses are described in detail in other patent documents by the same inventor, as noted below.

Backup capacitor 26 is charged by battery 18 (or perhaps by another power source) during normal operation. Capacitor 26 serves two functions, the first of which is to maintain adequate voltage to CPU 16 during either shackle drive circuit activation, or lock drive circuit activation. In an exemplary embodiment, capacitor 26 is charged from the regulated side of voltage regulator in power supply 18, whereas all electromechanical drive current is derived from the unregulated side of power supply 18. Capacitor 26 also maintains a stable voltage to CPU 16 during periods of high current drain on power supply 18. The second function of capacitor 26 is to maintain CPU 16 operation and RAM memory 22 during a period when the battery 18 is replaced.

Another sensor used in the present invention is the device that will detect the key security apparatus that is typically attached to the mechanical key 111, and which is depicted in most of the drawings of this patent document. This type of sensor is referred to on FIG. 4 as a key identification detector, generally designated by the reference numeral 31. The principle of operation of the key ID detector 31 would depend upon the type of key security apparatus that is being used with the mechanical key 111. If the key security apparatus comprises an RFID chip 125 with an antenna 110, then the ID detector 31 would be a device that emits an electromagnet signal and can detect a return response signal. This would use a transceiver, such as the transceiver 28 depicted on FIG. 4. On the other hand, if the mechanical key 111 is attached to a bar code tag 135 (see FIG. 5), then the ID detector 31 would be some type of bar code reader, which typically involves a low-power laser beam and some type of photodiode or other type of photosensor device. Such photosensor and photoemitter devices could, in a sense, be considered a transceiver.

If the key security apparatus comprises the electrical leads 151 with spring-loaded contacts 157, such as discussed above in reference to FIG. 3, then the ID detector 31 would work through the transceiver 28, which would communicate with the transceiver 126 in the apparatus depicted in FIG. 2. Certainly other types of devices could be used for the "key security apparatus" that is used for being detected by the key ID detector 31 of the electronic lock box in FIG. 4, without departing from the principles of the present invention.

In addition to the "standard" components found in earlier electronic lock boxes by the same inventor, in the present invention an extra sensor or two is included to accomplish some of the principles of the present invention. On FIG. 4, a door open/close sensor 30 is included, and interfaces to the microcontroller circuit 16 of the lock box 5. This sensor could be a simple contact switch.

A further possibility is to measure any change in inductance when the key security apparatus is attached to the key. A sensing coil could be placed near where the key attaches, and a signal passed through the coil could be used to measure the inductance, thereby indicating the presence or absence of the key.

Except for the directly-connected limit switch contact, the aforementioned embodiments might be preferred when it is necessary (or is at least desired) to electrically isolate the key from the key security apparatus. Much of today's CMOS-based control circuits are extremely sensitive to electrostatic discharge. Having metal contacts directly contacting the key might result in undesirable operation, and so the optoelectronic embodiment, the induction coil-sensing embodiment, and the other non-contact embodiments (e.g., the RFID tag, or bar code reader) would virtually eliminate that type of problem.

One methodology for implementing a key security apparatus is to equip the electronic lock box 5 with a small radio frequency antenna that is positioned inside the key compartment portion of the lock box, and this would be securely hidden behind the key compartment door 36. This situation would allow a mechanical key 111 to be attached to a key fob type device that includes a radio frequency transceiver, such as the embodiment in FIG. 1, in which the assembly 128 includes an RFID chip 125 with an antenna 110. Of course, this would also work with the embodiments of FIGS. 2 and 3, which also include a microcontroller and a transceiver circuit.

In any of these designs, the low-power radio frequency signal generated by the antenna inside the key compartment would not be able to easily escape through the metal enclosure of a standard electronic lock box, as currently manufactured by SentriLock, Inc. of Cincinnati, Ohio. Therefore, for the key to be properly detected, the key (along with its RF transceiver identification device) would have to be positioned within the secure compartment of the electronic lock box 5. In this situation, the electronic lock box 5 could directly determine whether or not the key assembly with its identifier tag or "key fob" is positioned within the key compartment (behind the key compartment door 36).

In one mode of the invention, the microcontroller 16 of the lock box 5 could periodically send a short RF transmission, and if it receives the proper response, it could deduce that the key assembly was currently positioned within the lock box key compartment. This periodic signal could be referred to as a "polling" signal, and if designed properly, the polling signal would only elicit an appropriate response from the "key fob" (i.e., the key identifier device) if the key fob was within range and could receive the polling signal, essentially by being within the lock box secure compartment. If the electronic lock box sends a polling signal and the key assembly has been removed, then generally there would not be a proper response. If an unscrupulous person attempted to fool the electronic lock box by tearing off the key fob and leaving it inside the secure compartment, then because of the circuitry discussed above, there would still not be a proper response from the key security apparatus, such as the "key fob" apparatus 123 of FIG. 1, the "key fob" apparatus 115 of FIG. 2, or the "key fob" apparatus 155 of FIG. 3. Since there are appropriate countermeasures in the design of the present invention, the unscrupulous person would be defeated in this attempt to fool the electronic lock box.

Reporting

In the above embodiments, the ability to sense whether the key has been returned to the secure compartment is coupled with an internal logging function by the microcontroller 16 in the lock box 5 to record the presence of the key. The data being logged will include time stamping the key sense events, so an accurate tracking of the lock box contents can be accomplished. This logging information can be further downloaded by the lock box owner via his or her "electronic key" device, or a secure memory card 3, and this data potentially may be uploaded at a later time to a central clearinghouse computer 60 for storage and later reporting.

Training

When a new key or other object is placed in the secure compartment, a training process is performed to store the ID of the key (or object) in the lock box microcontroller 16. In the case of real estate lock boxes, this typically is performed when the lock box is initially placed on a real estate listing (i.e., on the real property). The real estate agent (or other lock box owner) attaches the key security apparatus to the house key (e.g., in the form of a key fob). In the re-codeable apparatus embodiment, attaching the key security apparatus (123, 115, 155, 130) to the mechanical key 111 causes the key security apparatus to generate a random security code that is stored in such a way as to be erased or changed should the key security apparatus be detached from the key 111. The lock box owner executes a lock box function available only to the owner of the box, causing the lock box 5 to read the security ID from the key security apparatus (thereby "training" the key security device). This ID is stored in the lock box's memory 21 or 22 for future comparison and use in data or event logging. It should be noted that, with the appropriate transmission technology, multiple key security apparatuses can be placed in the secure compartment, and multiple security ID's can be stored in the lock box memory.

For greater security, the ID information can be encrypted during transmission, or a challenge response type mechanism between the lock box and the key security apparatus can be used to prevent possible eavesdropping on transmitted codes, thereby preventing a sophisticated unscrupulous individual from creating cloned key security apparatuses.

The coding system can further include utilizing a two-part code having a fixed portion and a variable portion. Lock boxes could be programmed to only allow training/mating with a specific subset of properly coded key security apparatuses. Such information could also be used mathematically to create a secure code generation scheme, in which a portion of each code is used to seed the mathematical (encryption/decryption) algorithm for both the lock box and key security apparatus.

It should be noted that, if desired, system operation could be simplified such that every access by the lock box owner could automatically re-train the lock box with the current key security apparatus ID. This could be made an optional feature that is set up by the lock box owner.

Operation

As noted above, a door sensor 30 can be included in the electronic lock box 5 to determine whether the secure compartment door 36 is open or closed. This door sensor 30, for example, could be a Hall effect device that detects a magnet which is integral to the secure compartment door 36, an electromechanical contact switch (also called a limit switch), or an optical detector that senses a sudden change in ambient light reaching the interior of the secure compartment. After the secure compartment door is closed, the lock box microcontroller 16 can detect the door closure event, and will activate another sensor 31 in the key security apparatus circuit to determine if the correct key (or object) has been returned to the secure compartment. This sensing function can occur via a variety of communications methods such as infrared, RFID or bar code scanning.

When the ID of the object is read by the key security apparatus, the observed ID information is compared with the ID information that earlier was stored in non-volatile memory of the microcontroller. The result of this comparison between the apparatus (or observed) ID with the stored (enrollment) ID can be recorded, which becomes an event status (of whether a match was found) in the internal activity log (or "event log") of the lock box. Several possible states could be stored such as: (1) apparatus ID could not be read, (2) apparatus ID does not match stored ID, and (3) apparatus ID read error. These different states can be stored in a log in the memory circuit of the electronic lock box, for later retrieval by the lock box owner. It can be also determined from the log whether the secure compartment door 36 was actually closed, if the lock box is designed to include that feature. A lack of log entries could indicate (or infer) that the door was not properly closed; or the lock box could record one or more entries to indicate that proper door closure had occurred.

In one operational mode of the present invention, the electronic lock box 5 can use its processing circuit 16 and transceiver 28 to detect the presence or lack of presence of the key identifier tag within the secure compartment of the lock box 5. The status of the key's presence can be detected and recorded (e.g., stored in memory) before access is granted, when an attempt at such access has occurred. In this manner, the electronic lock box 5 can create in effect an "audit trail" as an "event log" of the various status information that is available, with regard to whether or not the key identifier tag is present in the secure compartment, and also whether or not the secure compartment door 36 has been open or closed. The electronic lock box 5 also has knowledge, of course, as to whether an attempt at access is taking place, because the user must attempt to enter some data or some type of code into the lock box so that the lock box will willingly open its secure compartment door 36. This access attempt can be stored in a separate "access log," or both, if desired.

The controller 16 of the electronic lock box 5 can be programmed to detect and store the status of the key's presence in the secure compartment both just before and just after the secure compartment door 36 is opened by the lock box controller. On the other hand, when the secure compartment door 36 is closed, this typically is a manual operation, and the electronic lock box would have no "warning" that the door is about to be closed. Of course, once the secure compartment door 36 is closed, the status of the key's presence can then be detected, and that status can be stored in memory. All of these events can be stored in an "activity log," (or "event log") if desired, and this activity log could later be inspected and/or downloaded onto a user's secure memory card 3, or downloaded to a portable electronic key, such as a mobile phone or a wireless PDA, designated by the reference numeral 80 as seen on FIG. 7. The values in the activity log can not only be transferred to a secure memory card or to a wireless or portable electronic key, but this information can also be uploaded onto the clearinghouse computer system 60, either by use of the electronic key 80 or by presenting the secure memory card 3 to a card reader port at a REALTOR board office, for example.

Another operational possibility is for the electronic lock box 5 to periodically determine the presence or absence of the key identifier tag within its secure compartment. The processing circuit or controller 16 of the electronic lock box 5 can be programmed to periodically "poll" the status of the key identifier sensing device that supposedly is contained within the electronic lock box. As noted above, this identifier sensing device could be a transceiver circuit that uses radio frequency signals, or some type of optical device, such as a bar code reader, for example. In any event, the processing circuit 16 could periodically poll (transmit an inquiry signal) to determine the status of the key tag's presence or absence in the secure compartment, and this polling routine could be very infrequent, such as once or twice a day, if desired. On the other hand, if the lock box secure compartment door has been accessed, then the processing circuit 16 could be programmed to poll for this key presence status more frequently, such as every five minutes until the secure compartment door has been closed and the key identifier tag has been deposited back into the secure compartment. Or, for example, the more frequent polling could be at irregular time intervals, such as five minutes, fifteen minutes, fifteen minutes, fifteen minutes, and then once or twice a day, if desired.

In addition to these polling events, a time interval threshold could be programmed into the electronic lock box 5 so that if the secure compartment door is not closed with the key tag identifier contained within the secure compartment within a predetermined time interval, e.g., one hour or two hours, then the electronic lock box could be programmed to go into an "alarm state," in which it will no longer allow any type of accesses to its secure compartment unless it is accessed only by its owner (rather than some other real estate agent, for example). This is an optional feature of the present invention, and it may not be a desired feature for all REALTOR boards or lock box "owning agents."

Another operational feature of the present invention is the possibility of detecting not only the presence or absence of the identifier tag of the key within the secure compartment each time the secure compartment door 36 is either opened or closed, but the lock box processing circuit 16 can be programmed to also determine whether or not the identifier tag has been altered. As discussed above, the identifier tag should have a certain value, either a numeric data value or code, or some type of physical value, such as the electrical conductivity of a "sense loop," or the status of a bar code that is printed or otherwise labeled on the identifier tag. The correct value for any type of numeric result would be previously stored in the memory circuit of the electronic lock box 5, and this "enrollment value" should essentially match up to the current value that is determined each time the lock box door 36 is opened or closed. In the case of a physical parameter, such as the electrical conductivity (or resistance) of a sense loop, or an optical data pathway operational code, these values can have some predetermined tolerance, if desired, particularly for electrical conductivity, since that will likely change over time, even if the identifier tag has not been abused or intentionally altered.

To further enhance security, a challenge response system can be employed to prevent copying or cloning the key security apparatus. In one mode of the invention, the challenge response functions as follows: the lock box generates a random challenge which is transmitted to the key security apparatus. The key security apparatus generates a mathematical response, and transmits it to the lock box. The lock box generates the expected response internally and compares that to the received value from the key security apparatus. If a match is found between the transmitted code and the internally-generated code, the key security apparatus is valid. If not, it is assumed that the wrong key (or an attempted copy of the key security apparatus) has been made. This would result in a log entry such as: "apparatus ID is invalid."

Another aspect of the present invention is the ability to restrict access to the secure compartment based on its contents. A list of valid key apparatus ID's could be contained on a secure memory card, or on an "electronic key" apparatus, and the lock box could use that information to determine if access to the secure compartment should be allowed based on the keys that have been authorized. Many different devices could function as an "electronic key," including a PDA with special software.

It will also be understood that many of the components in the block diagram of FIG. 4 could be modified (or some even deleted) without departing from the principles of the present invention. Certainly computer technology will change over time, and some of the components listed in FIG. 4 may not even be in use, one day in the near future. The main processing functions (e.g., the identification procedure functions) could be implemented using sequential logic, such as by using microprocessor technology, or using a logic state machine, or perhaps by discrete logic; it also could be implemented using parallel processors.

All documents cited in the Background of the Invention and the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. It is intended to cover in the appended claims all such changes and modifications that are within the scope of this invention.

The invention claimed is:

1. An electronic lock box system, comprising:

an electronic lock box apparatus having a control circuit, a first memory circuit, an identifier sensing device, a secure compartment with an access element, a shackle for attachment to a fixed object, and a keypad for use by a user to enter authentication data for operating said access element of the secure compartment, wherein said control circuit is configured to exchange data signals with said identifier sensing device;

and a security apparatus having an identification member with a second memory circuit, and an attachment member with a key initially attached thereto;

wherein:

(a) said identifier sensing device detects a presence of the identification member of said security apparatus, if said security apparatus is positioned within said secure compartment;

(b) said identifier sensing device detects an absence of the identification member of said security apparatus, if said security apparatus is not positioned within said secure compartment; and (c) said control circuit is configured:

(i) to determine whether or not identification data that is entered on said keypad, by said user, is correct;

(ii) if so, then to read a first data value that is stored in said second memory circuit, and to command said access element to open, thereby allowing said user to obtain physical use of said security apparatus;

(iii) if said identifier sensing device determines that said key has been detached from said security apparatus, then to automatically alter said first data value to a different value, thereby generating a second data value, and to automatically store said second data value in said second memory of said security apparatus;

(iv) to detect, by use of said identifier sensing device, after said secure compartment has been opened, then later closed, a presence of said security apparatus and to read said second data value; and (v) to determine if said second data value is equal to said first data value, and if not, to store that status into an event log that is stored in said first memory circuit.

2. The electronic lock box system as recited in claim 1, wherein after the absence of said identification member has been detected, said control circuit of the electronic lock box apparatus alters a value of an internal security code in said memory circuit, and stores the absence status in an event log of a non-volatile memory portion of said memory circuit.

3. The electronic lock box system as recited in claim 1, wherein:

(a) the attachment member of said security apparatus is attachable to said key, (b) the identification member of said security apparatus includes a first security status when said security apparatus is attached to said key; and (c) if said key is removed from said attachment member, said first security status of the identification member becomes altered to a second security status.

4. The electronic lock box system as recited in claim 3, wherein said second security status comprises at least one of:

(a) a different data value than existed at the time said security apparatus was attached to said key;

(b) a disconnected antenna;

(c) a substantial change in electrical conductivity of an electrical sense loop than existed at the time said security apparatus was attached to said key;

(d) substantial change in optical transmission of an optical sense loop than existed at the time said security apparatus was attached to said key; and (e) an alteration of a visual indicia than existed at the time said security apparatus was attached to said key.

5. The electronic lock box system as recited in claim 4, wherein if said control circuit receives said different data value from said identifier sensing device, said control circuit is configured to recode a mismatch in an event log of a non-volatile memory portion of said memory circuit.

6. The electronic lock box system as recited in claim 4, wherein said key comprises one of:

(a) a mechanical key;

(b) a radio-frequency transmitter; and (c) a light beam emitter.

7. The electronic lock box system as recited in claim 6, wherein said mechanical key includes an opening therein, and the attachment member of said security apparatus extends through said opening of the mechanical key.

8. The electronic lock box system as recited in claim 1, wherein said security apparatus comprises one of:

(a) a radio frequency identification (RFID) chip and an RFID transceiver, and said attachment member comprises an antenna lead of said RFID chip;

(b) a radio transmitter and receiver, a processing circuit, and an input circuit that determines a continuity of said attachment member, which comprises an electrical conductor;

(c) a radio transmitter and receiver, a processing circuit, and an input circuit that determines a continuity of said attachment member, which comprises an electrical conductor that makes electrical contact through said mechanical key;

(d) a radio transmitter and receiver, a processing circuit, and an input circuit that determines a continuity of said attachment member which comprises a fiber optic cable;

(e) a wire that is electrically connected to said security apparatus and is mechanically connected to said key; and (f) bar code label.

9. The electronic lock box system as recited in claim 8, wherein said RFID tag is attached to said key in a manner by which it is virtually impossible to detach said RFID tag from said key without said identifier sensing device at least momentarily detecting the absence of said key.

10. The electronic lock box system as recited in claim 8, wherein said bar code decal is mechanically attached to said key in a manner by which it is virtually impossible to detach said bar code decal from said key without said identifier sensing device at least momentarily detecting the absence of said key.

11. The electronic lock box system as recited in claim 10, wherein if said key is removed from the security apparatus, said bar code decal becomes unreadable, and said identifier sensing device sends a signal to said control circuit informing the control circuit of the altered condition of said bar code decal.

12. The electronic lock box system as recited in claim 8, wherein said attachment member is attached to said key in a manner by which it is virtually impossible to detach said attachment member from said key without said identifier sensing device at least momentarily detecting the absence of said key.

13. The electronic lock box system as recited in claim 8, wherein if said key is removed from the security apparatus, and if said security apparatus is presented to the secure compartment of said electronic lock box apparatus, then said control circuit alters a value of a non-volatile memory element of said memory circuit, which disables further key-detecting functions of the electronic lock box apparatus.

14. The electronic lock box system as recited in claim 1, wherein said access element comprises one of:

(a) a pivotable door; and (b) a slidable tray.

15. The electronic lock box system as recited in claim 14, further comprising an access element sensing circuit that detects whether said secure compartment is in one of: (a) an open state; and (b) a closed state;

wherein said control circuit is further configured to exchange data signals with said door sensing circuit.

16. The electronic lock box system as recited in claim 15, wherein said access element sensing circuit comprises at least one of:

(a) an electromechanical contact limit switch;

(b) a metal-detecting proximity sensor;

(c) a magnetic sensor; and (d) an optical sensor.

17. The electronic lock box system as recited in claim 15, wherein said control circuit is further configured to:

(a) determine a present status of whether or not said security apparatus is positioned within said secure compartment, in response to said access element sensing circuit indicating that said access element has been opened; and (b) determine a present status of whether or not said security apparatus is positioned within said secure compartment, in response to said access element sensing circuit indicating that said access element has been closed.

18. The electronic lock box system as recited in claim 17, wherein said control circuit is further configured to:

(a) store an entry in an event log each time said access element sensing circuit indicating that said access element has been opened, and each time said access element sensing circuit indicating that said access element has been closed;

(b) wherein said entry includes:

(i) a status of whether said access element just opened or just closed, (ii) a status of whether or not said security apparatus was positioned within said secure compartment, and (iii) a status of whether or not the identification member of said security apparatus provided a correct identification result if said security apparatus was positioned within said secure compartment.

19. A security apparatus used with an electronic lock box system, said security apparatus comprising:

(a) an identification member, which includes an identification control circuit, a first memory circuit having alterable memory elements, a wireless transceiver, and at least one input/output circuit; and (b) an attachment member for use with an external key;

(c) wherein: said identification control circuit is configured to modify a first data value of said alterable memory elements, in response to said attachment member becoming detached from said key, and said identification control circuit remains enabled after modifying said first data value;

further comprising:

(d) an electronic lock box apparatus having a lockbox control circuit, a second memory circuit, an identifier sensing device, a secure compartment with an access element, wherein said lockbox control circuit is configured:

(i) to exchange data signals with said identifier sensing device;

(ii) during a procedure to obtain access to said secure compartment, to detect a presence of said security apparatus if said security apparatus is positioned within said secure compartment by using said identifier sensing device, and if so, then to read said first data value that was stored in said first memory circuit;

(iii) if said identifier sensing device determines that said key has been detached from said security apparatus, then to automatically alter said first data value to a different value, thereby generating a second data value, and to automatically store said second data value in said first memory circuit;

(iv) to detect, by use of said identifier sensing device, after said secure compartment has been opened, then later closed, a presence of said security apparatus and to read said second data value; and (v) to determine if said second data value is equal to said first data value, and if not, to store that status into an event log that is stored in said second memory circuit.

20. The security apparatus as recited in claim 19, wherein said attachment member comprises one of:

(a) a sense loop that makes electrical contact with said key, in which said key is electrically conductive; and (b) a sense loop that passes through an opening of said key; and (c) an antenna.

21. The security apparatus as recited in claim 19, wherein said identification control circuit is configured to modify a data value of said alterable memory elements so as to make the alterable memory elements become unreadable, in response to said attachment member becoming detached from said key.

22. A method for operating an electronic lock box system, said method comprising:

providing an electronic lock box apparatus having a control circuit, a first memory circuit, an identifier sensing device, a secure compartment with an access element, a shackle for attachment to a fixed object, and a keypad for use by a user to enter authentication data for operating said access element of the secure compartment; entering identification data on said keypad, by said user;

providing a key with a security apparatus attached thereto, said security apparatus having an identification member with a second memory circuit, and an attachment member, said attachment member being used for attaching said security apparatus to said key;

determining, by said control circuit: (a) whether or not said identification data is correct, and if so then, (b) commanding said access element to open, thereby allowing said user to obtain physical use of said key;

using said identifier sensing device, detecting a presence of the identification member of said security apparatus, if said security apparatus is positioned within said secure compartment, and if so, then reading a first data value that is stored in said second memory circuit;

automatically altering, only if said identifier sensing device determines that said key is has been detached from said security apparatus, said first data value to a different value, thereby generating a second data value and automatically storing said second data value in said second memory circuit of said security apparatus; after said secure compartment has been opened, then later closed, detecting, by use of said identifier sensing device, a presence of said security apparatus and reading said second data value that has been stored in said second memory circuit; and determining if said second data value is equal to said first data value, and if not, storing that status into an event log that is stored in said first memory circuit.

23. The method as recited in claim 22, further comprising the step of:

determining an absence of the identification member of said security apparatus, if said identifier sensing device does not detect its presence.

24. The method as recited in claim 22, further comprising the steps of:

allowing access to said secure compartment, by way of said access element, and allowing said key with the security apparatus to be removed from said secure compartment; and thereafter, sensing an absence of the identification member of said security apparatus, in response to said key with the security apparatus being removed from said secure compartment.

25. The method as recited in claim 22, wherein said key comprises one of:

(a) a mechanical key;

(b) a radio-frequency transmitter; and (c) a light beam emitter.

26. The method as recited in claim 22, wherein said security apparatus comprises one of:

(a) a radio frequency identification (RFID) chip and an RFID transceiver, and said attachment member comprises an antenna lead of said RFID chip;

(b) a radio transmitter and receiver, a processing circuit, and an input circuit that determines a continuity of said attachment member, which comprises an electrical conductor;

(c) a radio transmitter and receiver, a processing circuit, and an input circuit that determines a continuity of said attachment member, which comprises an electrical conductor that makes electrical contact through said mechanical key;

(d) a radio transmitter and receiver, a processing circuit, and an input circuit that determines a continuity of said attachment member which comprises a fiber optic cable;

(e) a wire that is electrically connected to said security apparatus and is mechanically connected to said key; and (f) bar code label.

27. The method as recited in claim 26, wherein:

(a) the identification member of said security apparatus includes a first security status when said security apparatus is attached to said key; and (b) if said key is removed from said attachment member, said first security status of the identification member becomes altered to a second security status, wherein said second security status comprises at least one of:

(i) a different data value than existed at the time said security apparatus was attached to said key;

(ii) a disconnected antenna;

(iii) a substantial change in electrical conductivity of an electrical sense loop than existed at the time said security apparatus was attached to said key;

(iv) substantial change in optical transmission of an optical sense loop than existed at the time said security apparatus was attached to said key; and (v) an alteration of a visual indicia than existed at the time said security apparatus was attached to said key.

28. The method as recited in claim 24, further comprising the steps of:

(a) upon removal of said key from said secure compartment, altering a value of an internal security code in an alterable memory element of said electronic lock box controller; and (b) storing the altering value event in an event log of a non-volatile memory circuit of said electronic lock box controller.

29. The method as recited in claim 22, further comprising the steps of:

(a) altering a parameter of said identification member if said key is removed from the attachment member of said security apparatus; and (b) disabling further key-detecting functions of said electronic lock box controller, if said identifier sensing device detects said altered parameter.

30. The method as recited in claim 29, further comprising the steps of:

(a) re-connecting said attachment member to said key;

(b) allowing an owner of said electronic lock box apparatus to re-enable the key-detecting functions of said electronic lock box controller; and (c) placing said key back into said secure compartment, wherein said identifier sensing device now again detects a presence of the identification member of said security apparatus.

31. The method as recited in claim 22, further comprising the step of determining whether an incorrect key has been placed within said secure compartment, by:

(a) generating a random challenge, by said electronic lock box control circuit, that is transmitted to said key positioned in said secure compartment;

(b) generating a mathematical response, by said security apparatus of said key, and transmitting said response to said electronic lock box apparatus;

(c) generating, by said electronic lock box control circuit, an expected value of said random challenge; and (d) comparing, by said electronic lock box control circuit, said key's mathematical response to said expected value, to determine if said key is correct.

32. The method as recited in claim 22, further comprising the step of:

(a) providing an access element status detection device with said electronic lock box apparatus; and (b) further comprising at least one of the steps of:

(i) upon closing the access element of said electronic lock box secure compartment, initiating a sensing operation of the security apparatus using said identifier sensing device; and (ii) upon opening the access element of said electronic lock box secure compartment, initiating a sensing operation of the security apparatus using said identifier sensing device.

33. The method as recited in claim 22, further comprising at least one of the steps of:

(a) updating an internal identification code in a memory element of the identification member of said security apparatus in response to a mechanical key being removed from the attachment member of said security apparatus; and (b) updating said internal identification code in said memory element of the identification member of said security apparatus in response to a mechanical key being attached to the attachment member of said security apparatus.

34. The method as recited in claim 22, further comprising the step of training said electronic lock box apparatus by storing a security apparatus identification code in said memory circuit, in response to an electronic lock box owner operating said electronic lock box apparatus while an individual security apparatus is present in said secure compartment.

35. The method as recited in claim 22, wherein said identifier sensing device comprises one of:

(a) a wireless transceiver; and (b) a bar code reader.

36. A method for operating an electronic lock box system, said method comprising:

providing an electronic lock box apparatus having a control circuit, a first memory circuit, an identifier sensing device, a secure compartment with an access element, an access element status detection device, and a shackle for attachment to a fixed object;

installing said lock box apparatus at said fixed object by use of said shackle;

installing a key within said secure compartment, said key having a security apparatus attached thereto, said security apparatus having an identification control circuit, and a second memory circuit having alterable memory elements;

detecting an access attempt of said secure compartment by an authorized user;

before opening said secure compartment access element, detecting, by use of said identifier sensing device, a presence of said security apparatus and determining a first data value that has been stored in a predetermined set of memory elements of said second memory circuit;

storing said first data value in said first memory circuit of said electronic lock box;

opening said secure compartment access element, thereby allowing physical access to said key;

automatically altering, only if said identifier sensing device determines that said key has been detached from said security apparatus, said first data value to a different value, under the control of said identification control circuit, thereby generating a second data value and automatically storing said second data value in said predetermined set of memory elements of said second memory circuit of said security apparatus;

after said secure compartment has been opened, then later closed, detecting, by use of said identifier sensing device, a presence of said security apparatus and reading said second data value that has been stored in said second memory circuit; and determining if said second data value is equal to said first data value, and if not, storing that status into an event log that is stored in said first memory circuit.

37. The method as recited in claim 36, further comprising the step of storing in said first memory circuit a "presence status" event message of said security apparatus, if said security apparatus was positioned within said secure compartment before said access member was opened.

38. The method as recited in claim 37, further comprising the steps of:

(a) providing a separate secure memory device;

(b) providing a first access port to allow said electronic lock box apparatus control circuit to exchange data with said secure memory device;

(c) providing a remote central computer that has a second access port to allow said remote central computer to exchange data with said secure memory device;

(d) transferring said "presence status" event message from said electronic lock box apparatus control circuit to said secure memory device; and (e) later, transferring said "presence status" event message from said secure memory device to said remote central computer.

39. The method as recited in claim 36, further comprising the step of storing in said first memory circuit an "absence status" event message of said security apparatus, if said security apparatus was not positioned within said secure compartment before said access member was opened.

40. The method as recited in claim 39, further comprising at least one of the steps of:

(a) preventing said secure compartment access member from opening, and placing said electronic lock box apparatus into an alarm state that prevents its functioning until serviced by an authorized owner; and (b) allowing said secure compartment access member to open, and storing an "alarm status" message in said first memory circuit.

41. The method as recited in claim 36, further comprising the steps of:

(a) detecting a closure of said secure compartment access element;

(b) then, detecting the presence or absence, by use of said identifier sensing device, of said security apparatus within said secure compartment;

(c) storing in said first memory circuit a "presence status" event message of said security apparatus, if said security apparatus is positioned within said secure compartment after said access member was closed; and (d) storing in said first memory circuit an "absence status" event message of said security apparatus, if said security apparatus is not positioned within said secure compartment after said access member was closed.

42. A method for operating an electronic lock box system, said method comprising:

providing an electronic lock box apparatus having a control circuit, a first memory circuit, an identifier sensing device, a secure compartment with an access element, an access element status detection device, and a shackle for attachment to a fixed object;

installing said lock box apparatus at said fixed object by use of said shackle;

installing a key within said secure compartment, said key having a security apparatus attached thereto, said security apparatus having an identification control circuit, and a second memory circuit having alterable memory elements;

detecting an access attempt of said secure compartment by an authorized user;

before opening said secure compartment access element, detecting, by use of said identifier sensing device, a presence of said security apparatus and determining a first data value that has been stored in a predetermined set of memory elements of said second memory circuit;

storing said first data value in said first memory circuit of said electronic lock box;

opening said secure compartment access element, thereby allowing physical access to said key;

altering, if said key is detached from said security apparatus, said first data value to a different value, under the control of said identification control circuit, thereby generating a second data value and storing said second data value in said predetermined set of memory elements of said second memory circuit of said security apparatus;

after said secure compartment has been opened, then later closed, detecting, by use of said identifier sensing device, a presence of said security apparatus and reading said second data value that has been stored in said second memory circuit; and determining if said second data value is equal to said first data value, and if not, storing that status into an event log that is stored in said first memory circuit;

generating, at said electronic lock box, a random challenge that is sent to said security apparatus;

generating, at said identification control circuit of the security apparatus, a mathematical response that is sent to said electronic lock box;

generating, at said lock box control circuit, the expected response, and comparing said expected response to said received mathematical response; and if a match is found between said expected response and said received mathematical response, then said security apparatus is deemed valid.

43. The method as recited in claim 36, further comprising the steps of:

after said second data value has been found to be not equal to said first data value, executing a training step so that said electronic lock box will again recognize said security apparatus as being genuine, under control of an electronic lock box owner.

44. A method for operating an electronic lock box system, said method comprising:

providing an electronic lock box apparatus having a control circuit, a first memory circuit, an identifier sensing device, a secure compartment with an access element, and a shackle for attachment to a fixed object;

providing a key, said key having a security apparatus attached thereto, said security apparatus having an identification control circuit and a second memory circuit, said second memory circuit having memory elements that hold a two-part security ID code, in which: (a) a first portion of the security ID code is fixed, and (b) a second portion of the security ID code is variable;

training said security apparatus so that a lock box user identification attribute is used to generate said second portion of the security ID code, and storing said second portion in said second memory circuit;

during a procedure to obtain access to said secure compartment, detecting a presence of said security apparatus if said security apparatus is positioned within said secure compartment by using said identifier sensing device, and if so, then reading a first data value that was stored in said second memory circuit; automatically altering, only if said identifier sensing device determines that said key is has been detached from said security apparatus, said first data value to a different value, thereby generating a second data value and automatically storing said second data value in said second memory circuit of said security apparatus; after said secure compartment has been opened, then later closed, detecting, by use of said identifier sensing device, a presence of said security apparatus and reading said second data value that has been stored in said second memory circuit; and determining if said second data value is equal to said first data value, and if not, storing that status into an event log that is stored in said first memory circuit.

45. The method as recited in claim 44, further comprising the step of:

limiting said variable second portion of the security ID code to a predetermined subset of possible coded security apparatus devices.

46. The method as recited in claim 44, further comprising the step of:

mathematically creating a secure code generation scheme, by using both said fixed first portion of the security ID code and said variable second portion of the security ID code to seed a mathematical encryption/decryption algorithm, to be used in communicating data between said electronic lock box and said security apparatus.

47. The method as recited in claim 44, further comprising the steps of:

after said two-part security ID code has been deemed invalid for a particular security apparatus, re-training said electronic lock box, by:

(i) having an electronic lock box owner operate said electronic lock box apparatus while said particular security apparatus is present in said secure compartment;

(ii) uploading a present value for said security ID code from said particular security apparatus to said control circuit of said electronic lock box; and (iii) storing said present value for said security ID code into said first memory circuit, and programming said control circuit to accept that present value as valid.

48. The method as recited in claim 44, further comprising the steps of:

providing a first wireless transceiver circuit at said electronic lock box apparatus that is in communication with said control circuit; and providing a portable electronic key apparatus having a microcontroller, a third memory circuit, and a second transceiver circuit that is in communication with said microcontroller and also is in communication with said first wireless transceiver circuit under the control of a user;

wherein: said step of training said security apparatus is in response to detecting authorizing data that is contained in said third memory circuit of said electronic key.

* * * * *